United States Patent [19]

Morimoto et al.

[11] Patent Number: 4,582,210

[45] Date of Patent: Apr. 15, 1986

[54] CASING FOR DISPLAY DEVICE

[75] Inventors: Kiyoshi Morimoto; Shigeo Itoh; Hiroshi Watanabe; Mikio Yokoyama; Takeshi Tonegawa, all of Mobara, Japan

[73] Assignee: Futaba Denshi Kogyo K.K., Mobara, Japan

[21] Appl. No.: 627,531

[22] Filed: Jul. 3, 1984

[30] Foreign Application Priority Data

Jul. 5, 1983 [JP] Japan ..... 58-103527[U]

[51] Int. Cl.[4] ..... H01K 3/22

[52] U.S. Cl. ..... 220/2.2; 313/567; 313/573

[58] Field of Search ..... 220/2.2; 313/567, 566, 313/569, 572, 573, 577

[56] References Cited

U.S. PATENT DOCUMENTS

| | | | |
|---|---|---|---|
| 2,141,905 | 12/1938 | Fonda et al. | 313/573 X |
| 2,887,737 | 5/1959 | Prescott | 220/2.2 X |
| 3,493,805 | 2/1970 | Bass | 313/567 X |
| 3,551,725 | 12/1970 | Brundige | 220/2.2 X |
| 4,195,745 | 4/1980 | Roberts et al. | 220/2.2 |

*Primary Examiner*—Steven M. Pollard

*Attorney, Agent, or Firm*—Oblon, Fisher, Spivak, McClelland & Maier

[57] ABSTRACT

A casing for a display device of the tipless type is disclosed which is capable of being readily manufactured, and allowing a display device to have a good space factor and exhibit excellent display characteristics. The casing comprises a casing body formed with an evacuation hole and a plate lid member arranged to sealingly close the evacuation hole by means of an oxide solder layer when the casing is evacuated.

10 Claims, 8 Drawing Figures

CASING FOR DISPLAY DEVICE

BACKGROUND OF THE INVENTION

1. Field of the Invention

This invention relates to a casing for a display device such as a fluorescent display device, and more particularly to a casing for a display device of the tipless type that an evacuation tube is not used.

2. Description of the Prior Art

A typical fluorescent display device is a display device which has been conventionally used. In the fluorescent display device, a casing in which electrodes such as an anode, a control electrode, a cathode and the like are arranged in an evacuation tube having a tip tube projecting outwardly from the casing through which the interior of the casing is evacuated to a high vacuum. Once the evacuation of the casing is carried out, the tip tube is sealed by melting to keep the casing at a high vacuum.

However, the conventional casing has a disadvantage of causing a display device to have a low space factor, because the tip tube remains projected outwardly from the casing after it is sealed. Also, the tip tube is formed of glass inferior in impact resistance, resulting in the fluorescent display device being inferior in durability.

In view of the foregoing, a casing for a fluorescent display device of the tipless type has been proposed which is constructed in a manner as shown in FIG. 1. In the casing shown in FIG. 1, a glass substrate A is formed with a through-hole B and a ceramic element D is bonded onto the inner surface of the through-hole B by means of frit glass C. The ceramic element D is formed with a through-hole E of a smaller diameter substantially concentrical with the through-hole B, and a metallized layer F is deposited on the inner side surface of the through-hole E and on the surface portion of the ceramic element D adjacent to the through-hole E and opposite to the through-hole B. The hermetic sealing of the casing is carried out by heating the vicinity of the through-hole E to melt a brazing material G filled in the through-hole E. After the casing is evacuated, material G is filled in the through-hole E.

However, the conventional casing of such construction has not been put into practice due to the following disadvantages.

One of the disadvantages is that the casing is hard to be manufactured and complicated in structure because it is required to form the ceramic element highly hard in working with the through-hole E and also it is necessary to fix the ceramic element D with respect to the through-hole B of the glass substrate A from the inside of the casing in a specific atmosphere.

Another disadvantage is that a vapor of metal generated from the brazing material G and gas generated from organic flux by heating remain in the casing not only to be reactively absorbed in an oxide cathode to cause sintering, to thereby hinder the electron discharging capacity of the cathode but to cause the decrease in vacuum within the casing and the contamination of the surface of a fluorescent layer to decrease display characteristics of the fluorescent display device, because the through-hole E of the substrate A is sealedly filled with the brazing material G by melting.

SUMMARY OF THE INVENTION

The present invention has been made in view of the foregoing disadvantages of the prior art.

Accordingly, it is an object of the present invention to provide a casing for a display device of the tipless type which is simple in construction and readily manufactured.

It is another object of the present invention to provide a casing for a display device of the tipless type which does not decrease the display characteristics of the display device.

In accordance with the present invention, there is provided a casing for a display device which has at least a part thereof opened and is sealed at the opened portion in a vacuum atmosphere to allow a vacuum to be formed in the interior of said casing comprising a casing body formed with an evacuation hole, and a plate lid member for closing said evacuation hole, at least one of said plate lid member and said casing body being formed at the joint therebetween with an oxide solder layer.

BRIEF DESCRIPTION OF THE DRAWINGS

Other objects and many of the attendant advantages of the present invention will be readily appreciated as the same becomes better understood by reference to the following detailed description when considered in connection with the accompanying drawings in which like reference characters designate the same parts throughout, wherein.

DETAILED DESCRIPTION OF THE PREFERRED EMBODIMENTS

Now, a casing for a display device of the tipless type according to the present invention will be described with reference to FIGS. 2 to 8.

The following description will be made in connection with a casing for a fluorescent display device of the tipless type. However, it is a matter of course that the present invention is not limited to such a casing for a fluorescent display device.

Figure 1:
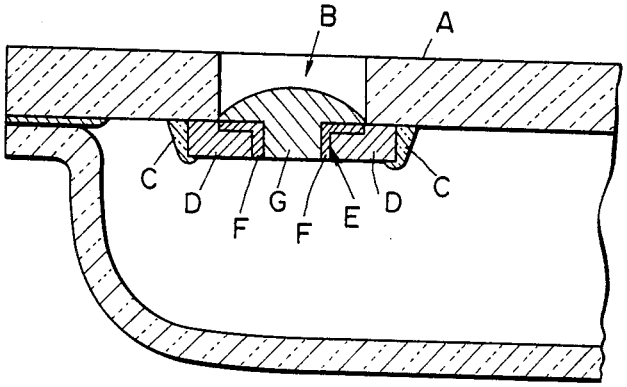
FIG.1 (PRIOR ART)
FIG. 1 is a sectional view showing the essential part of a conventional casing for a fluorescent display device of the tipless type.
Figure 2:
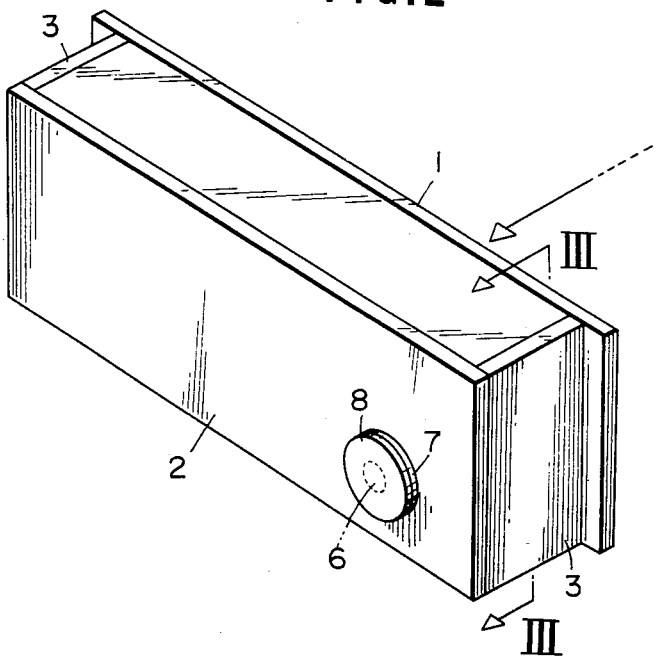
FIG. 2 is a perspective view showing a first embodiment of a casing for a display device of the tipless type according to the present invention.
Figure 3:
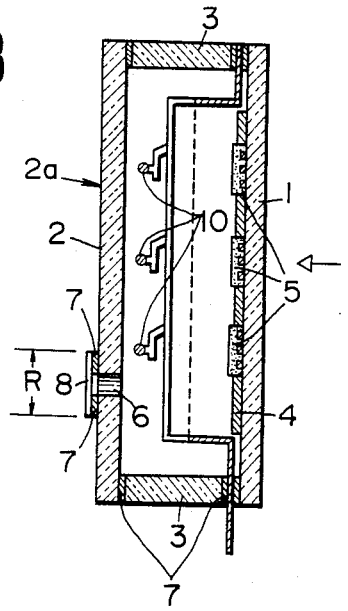
FIG. 3 is a vertical sectional view taken along line III—III of FIG. 2.

FIG. 2 is a rear perspective view of a casing for a fluorescent display device of the tipless type which is a first embodiment of the present invention, and FIG. 3 is a sectional view taken along line III—III of FIG. 2. The casing for a fluorescent display device shown in FIG. 3 includes a casing body comprising a substrate 1 and a rear cover 2 each formed of an insulating plate material such as a glass plate and side plates 3 peripherally arranged between the substrate and the rear cover 2, which are sealedly bonded together by an oxide solder layer 7 acting as a sealant as shown in FIG. 3.

The rear cover 2 is formed at any portion thereof with a through-hole or evacuation hole 6 for communicating the exterior of the rear cover 2 with the interior of the casing body. In the illustrated embodiment, the evacuation hole 6 is provided at the corner portion of the rear cover 2. The evacuation hole 6, as shown in FIG. 3, is sealedly closed by a plate lid member 8 by means of an oxide solder layer 7 applied to the outer surface 2*a* of the rear cover 2, to thereby keep the interior of the casing body at a high vacuum when it is evacuated.

A material suitable for the oxide solder layer 7 used for bonding the plate lid member 8 to the rear cover 2 includes various solder materials such as low-melting solder mainly consisting of lead oxide (PbO) and high-melting solder mainly consisting of $Al_2O_3$ and CaO. In the illustrated embodiment, the oxide solder layer 7 is formed of low-melting solder comprising low-melting amorphous glass mainly consisting of PbO. The oxide solder layer 7 is the same as that used to bond the glass substrate 1, rear cover 2 and side plates 3 together to form the casing body in the illustrated embodiment and conventionally used in the art. It is well known in the art that such an oxide solder layer provides sufficient bonding strength and sealing properties when glass plates are bounded to each other.

The oxide solder layer 7 may contain a conductor which is formed into a suitable shape such as a ring-like shape, a rectangular shape, a particle shape or the like. The conductor is preferably formed of a material generating high frequency induced current (eddy current) due to the high frequency induction action, and more preferably formed of a ferromagnetic material such as iron.

Figure 4:
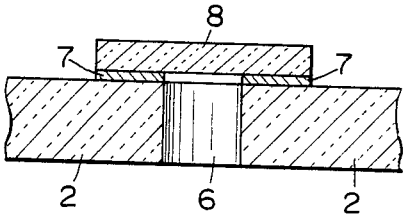
FIG. 4 is a vertical sectional view showing the essential part of the first embodiment shown in FIGS. 2 and 3.

FIG. 4 shows the essential part of the first embodiment shown in FIGS. 2 and 3. In the first embodiment, as described above, the evacuation hole 6 is provided adjacent to the corner portion of the rear cover 2 of the casing body. The plate lid member 8 is arranged on the outer surface of the rear cover 2 through the oxide solder layer 7 to sealingly close the evacuation hole 6. The plate lid member 8 is made of glass to have a dimension larger than the diameter of the evacuation hole 6 and may be formed into a suitable flat shape such as a circular shape as shown in FIG. 2, a rectangular shape or the like. The oxide solder layer 7 is annularly applied to the glass lid member 7 except the portion thereof opposite to the evacuation hole 6. The plate lid member 8 having the oxide solder layer 7 deposited thereon is subjected to preliminary calcination at a temperature between 300° C. and 500° C. for several ten hours in the atmosphere to remove a binder by vaporization and then placed on the rear cover 2 to sealingly close the through-hole 6.

The so-formed casing is subsequently placed in an evacuation system (not shown) to evacuate the casing to a predetermined vacuum and heated at a relatively low temperature which does not cause the outflow of the oxide solder layer 7 due to melting, for example, at a temperature below 400° C. for about 10–30 minutes to allow a sufficient baking treatment to be carried out, to thereby sealingly close the evacuation hole 6. Alternatively, the closing of the evacuation hole 6 may be carried out in a manner to heat the rear cover 2 at a temperature of 200°–400° C. to activate an oxide cathode 10 and then rapidly heat only the plate lid member 8 to heat the oxide solder layer 7 to a working temperature and concurrently deposit the oxide solder layer 7 around the evacuation hole 6 under pressure. The plate lid member 8 is cooled after completion of the sealing.

When the closing of the evacuation hole 6 is carried out using the oxide solder layer 7 containing a conductor, high frequency voltage is selectively applied to the conductor contained in the oxide solder layer 7 by means of a high frequency induction heating source (not shown) installed at the outside of the evacuation system. This allows high frequency induced current (eddy current) to flow through the conductor due to the high frequency induction action to cause eddy current loss and further cause hysteresis loss where the conductor is made of a ferromagnetic material, so that the conductor may carry out heat generation sufficient to rapidly heat and melt the oxide solder layer 7 to sealingly close the through-hole 6. In this case, the caloric value of the conductor may be readily controlled only by determining the characteristics of high frequency induced current such as voltage, phase, time and the like, to thereby precisely determine a temperature of the oxide solder layer 7 to be heated.

The heating is stopped upon completion of closing the evacuation hole 6 by means of the oxide solder layer 7 and the layer 7 is allowed to be cooled.

A fluorescent display device having the casing formed by sealing in a high vacuum atmosphere is finished through getter, open and aging processes.

A second embodiment of a casing for a display device of the tipless type according to the present invention will now be described with reference to FIG. 5.

Figure 5:
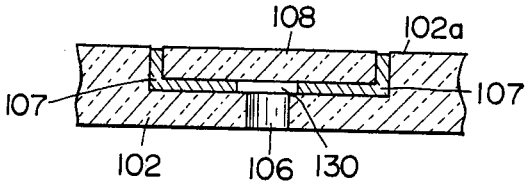
FIG. 5 is a vertical sectional view showing the essential part of a second embodiment of a casing for a display device of the tipless type according to the present invention.

In the second embodiment shown in FIG. 5, a rear cover 102 of a casing body is formed at the outer surface 102*a* thereof with a recess 130 which is concentric with an evacuation hole 106 and in communication therewith. The recess 130 is formed to have a depth and a configuration sufficient to receive a plate lid member 108 therein. Oxide solder as in the first embodiment described above is previously applied to the recess 130 to form an oxide solder layer 107, the plate lid member 108 subjected to preliminary calcination is received in the recess 130 to assemble a casing, and the so-assembled casing is placed in an evacuation system as in the first embodiment to allow the plate lid member 108 to sealingly close the evacuation hole 106. The second embodiment, as shown in FIG. 5, is adapted to apply the oxide solder layer 107 to the bottom and side surfaces of the plate lid member 108 except the portion facing the evacuation hole 106, to firmly sealingly fix the plate lid member 108 in the recess 130. As is apparent from the foregoing, the second embodiment can substantially reduce the thickness of a casing because the plate lid member 108 is sealedly received in the recess 130 to prevent the plate lide member 108 from projecting from the outer surface 102*a* of the rear cover 102.

Figure 6:
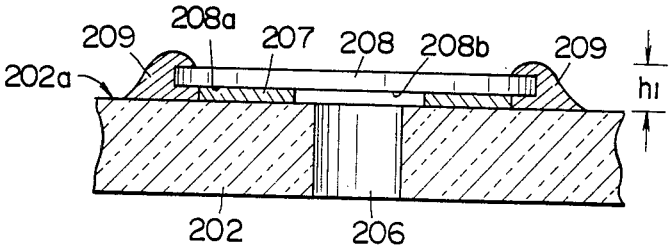
FIG. 6 is a vertical sectional view showing the essential part of a third embodiment of a casing according to the present invention.

FIG. 6 shows a third embodiment of a casing for a display device according to the present invention wherein a plate lid member 208 is formed of a flat metal sheet.

A metal sheet is generally superior in impact resistance to a glass sheet, resulting in a thin metal sheet exhibiting substantially the same strength as a much thicker glass sheet does. Thus, it will be noted that a metal sheet is superior in space factor to a glass sheet.

In the third embodiment shown in FIG. 6, the plate lid member 208 is desirably formed of metal having substantially the same coefficient of thermal expansion as glass which is a material for a rear cover 202 having an evacuation hole 206 formed therethrough. Such a metal material includes 426 alloy consisting of Ni, Cr and Fe (Ni: 42%, Cr: 6%, Fe: rest), Ni alloy, Cr alloy, Fe alloy and the like.

In the third embodiment, the plate lid member 208 is formed of 426 alloy into any of various shapes. The so-formed lid member 208 may be bonded to the rear cover 202 through an oxide solder layer 207 to sealingly close the evacuation hole 206 without being subjected to any treatment as in the first embodiment. However, for the purpose of exhibiting improved bonding strength, it is preferable to form an oxide layer on the surface of the lid member 208 to improve the conformability between the oxide solder layer and the plate lid member. The formation of such oxide layer may be carried by heating the lid member 208 at a temperature of 1000° C. in a hydrogen stream containing saturated steam to form a film of iron oxide such as $Fe_3O_4$ and that of chromium oxide such as $Cr_2O_3$.

To the plate lid member 208 subjected to the oxidation treatment is then applied oxide solder to form the oxide solder layer 207 of a predetermined shape. In the embodiment, the layer 207 is formed into a ring-shape, however, it may be deposited on the entire surface of the lid member 208. Then, the lid member 208 is subjected to preliminary calcination at a temperature between 300° C. and 500° C. for several minutes in the atmosphere to carry out the decomposition and vaporization of organic solvent and vehicle contained in the oxide solder. Thereafter, the lid member 208 is put on the rear cover 202 to close the evacuation hole 206 and then subjected to evacuation, heating and sealing treatments as in the glass lid members 8 and 108 described above, to thereby form a casing. The so-formed casing is allowed to be cooled upon completion of the sealing. However, an adhesive 209 may be further applied to the outer periphery of the lid member 208 to reinforce the bonding strength of the oxide solder layer 207.

Thus, it will be noted that the third embodiment can readily sealingly close the evacuation hole 206 keeping the casing at a vacuum, because it is merely required to deposit the oxide solder layer 207 on the lid member 208 made of sealing alloy of which working and forming can be readily accomplished, position the oxide solder layer 207 at the periphery of the evacuation hole 206 at which the lid member 208 and the rear cover 202 are to bonded together, and heat the oxide solder layer 207 in a vacuum atmosphere under pressure to bond the lid member and rear cover together. Thus, the casing of the third embodiment can be readily manufactured and significantly simplified in structure as compared with the conventional casing described above. Also, the casing shown in FIG. 6 is constructed in the manner to substantially deposit the oxide solder layer 207 on the outside of the casing or the outer surface 202*a* of the rear cover 202, different from the conventional casing having frit glass for bonding a ceramic element deposited in the casing. Thus, it can minimize the entering of decomposition gas generated due to heating of the oxide solder layer 207 into the casing. This effectively prevents the decrease in electron emission efficiency of an oxide cathode arranged in the casing, the decrease in the degree of vacuum in the casing and the contamination on the surface of a phosphor layer deposited on an anode.

Further, it is widely known in the art that sealing alloy for the lid member 208 and oxide solder for the layer 207 in the third embodiment have been extensively used for a lead frame and as a sealant for a casing in a fluorescent display device, respectively. This reveals that sealing alloy and oxide solder have excellent conformability with respect to glass material. Furthermore, the use of metal material, particularly, sealing alloy for the lid member 208 ensures the sufficient mechanical strength and thermal strength with a highly small thickness as compared with the thickness of the rear plate 202, so that the mounting of the lid member 208 on the outer surface of rear cover 202 does not substantially interfere with the construction of the casing because the height $h_1$ of projection of the lid member is substantially neglected. This allows a peripheral device such as a driving circuit to be arranged in close proximity to the rear cover 202.

Also, the third embodiment may be constructed in such a manner that the rear cover 202 is provided with a recess as the recess 130 in the second embodiment and the lid member 208 is received in the recess.

Figure 7:
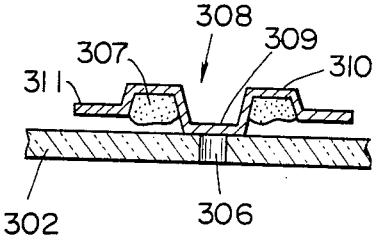
FIG. 7 is a vertical sectional view showing the essential part of a fourth embodiment of a casing according to the present invention.
Figure 8:
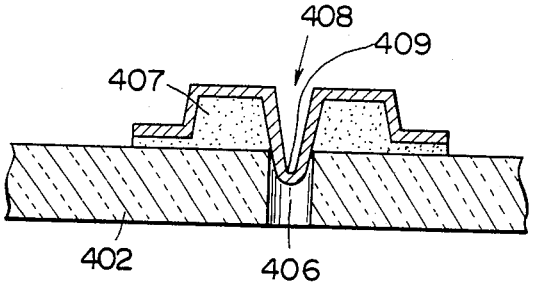
FIG. 8 is a vertical sectional view showing the essential part of a modification of the casing shown in FIG. 7.

FIG. 7 shows a fourth embodiment of a casing according to the present invention, wherein a plate lid member 308 may be formed of 426 alloy, glass, ceramic or the like. The lid member 308 is formed at the central portion thereof with a circular depression 309 having a flat bottom surface through which the lid member 309 is closely contacted with a rear cover 302. The depression 309 has a diameter larger than that of an evacuation hole 306 to close it and prevent oxide solder for a layer 307 from entering the hole 306. The lid member 308 also has an annular hollow projection 310 formed at the periphery of the depression 309 and concentric therewith. The projection 310 has a height sufficient to allow a suitable amount of oxide solder to be charged therein. The lid member 308 is also formed with a flange-like flat portion 311 at the periphery of the projection 310. The flat portion is formed at a position somewhat higher than the depression 309, so that a space may be defined between the flat portion 311 and the rear cover 302 as shown in FIG. 7 when the evacuation hole 306 of the rear cover 302 is covered with the lid member 308. The space serves to allow the oxide solder melted by heating at the time of bonding the lid member 308 to the rear cover 302 to flow outward through the space without entering the evacuation hole 306, to thereby fix the lid member 308 on the rear plate 302. The lid member 308 may be subjected to a heat treatment to form an oxide film thereon, to thereby exhibit good conformability with respect to the oxide solder. Also, the depression 309 may be formed into a shape suitable to be fitted in the evacuation hole 306. For example, the depression 309 may be formed into an inverted conical shape as shown in FIG. 8.

The embodiments described above each are constructed to form the rear cover of the casing body with the evacuation hole and sealingly close the evacuation hole with the lid member. However, in the casing of the present invention, the evacuation hole may be provided at the substrate i.e., front cover or the side plate and closed with the lid member. Also, in the present invention, a plurality of such evacuation holes may be formed in the casing body.

In a high luminance fluorescent display device, a casing is often formed at a part thereof by a metal material instead of a glass material to promote heat dissipation. When the present invention is applied to a fluorescent display device of such type, the evacuation hole formed at the metal portion of the casing body can be effectively sealedly closed by the lid member through the oxide solder layer.

Applications of the casing for a display device of the present invention, as described above, are not limited to a fluorescent display device. For example, the present invention may be applied to a display device of which a casing has a specific atmosphere, such as, for example, a plasma display panel (PDP) or the like.

Now, results of pressure test and thermal shock test carried out on the casing of the present invention will be described hereinafter.

The pressure test was carried out in a manner to apply pressure of atmospheric pressure plus 0.4 kg/cm$^2$ to the casing body at the first stage to observe the peeling between the casing body and the lid member and apply pressure of atmospheric pressure plus 0.7 kg/cm$^2$ to the casing body at the second stage to observe crack, failure, damage and the like of the lid member, various portions of the casing body and the joint between the lid member and the casing body. No damage was observed in the casing of the present invention.

The heat shock test took place by varying a temperature within the range of $-55°$ C. to $+80°$ C. to apply thermal shock of 5 cycles to the casing. No damage was observed.

As described hereinbefore, the casing of the present invention is constructed in the manner to form the evacuation hole at any position of the casing body and deposit the oxide solder layer at the joint between the casing body and the lid member for sealingly closing the evacuation hole.

Thus, the casing of the present invention can be readily manufactured. It is substantially simplified in structure, which allows productivity to be significantly improved. Moreover, the bonding of the lid member to the casing body is readily carried out only by heating the lid member from the outside of the casing body in a specific atmosphere.

Also, in the present invention, the oxide solder layer is substantially deposited on the outside of the casing body and the lid member is adapted to sealingly cover the evacuation hole through the layer. Thus, even if toxic gas is generated from the oxide solder layer at the time of melting the layer by heating, the entrance of the gas into the casing is minimized to allow a specific atmosphere in the casing to be kept so that a display device of the tipless type may be realized which exhibits excellent display characteristics.

Further, the lid member is formed of a metal material or glass material into a flat shape to have a substantially small thickness, so that the projection of the lid member from the casing body may be minimized to allow a display device comprising the casing to exhibit a good space factor. Also, this results in a peripheral device such as a driving circuit being readily arranged in close proximity to the casing.

Furthermore, the present invention permits manufacturing cost of the casing to be significantly reduced, because the lid member can be formed of a metal material or glass material.

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A fluorescent display device having an improved casing, said display device comprising:

(a) a casing body containing an evacuated chamber, said casing body comprising a glass plate having an evacuation hole extending from an exterior opening in the exterior surface of said glass plate to said evacuated chamber, said glass plate having a planar exterior surface surrounding said exterior opening of said evacuation hole, said evacuation hole being used during assembly of the fluorescent display device to evacuate said evacuated chamber;

(b) means for generating fluorescent light disposed in said evacuated chamber;

(c) a plate lid member having a first portion which makes planar sealing contact with said planar exterior surface of said glass plate surrounding said exterior opening of said evacuation hole and a second portion which is located outwardly of said first portion with respect to said evacuation hole and which is spaced from said glass plate; and (d) an oxide solder layer disposed between said second portion of said plate lid member and said glass plate, whereby, during assembly of the fluorescent display device, said evacuated chamber is evacuated through said evacuation hole, after which said plate lid member is positioned such that its first portion makes planar sealing contact with said planar exterior surface of said glass plate surrounding said exterior opening of said evacuation hole, after which said plate lid member is fixed in position by melting said oxide solder layer with substantially none of the fumes from the melting solder reaching said evacuated chamber through said evacuation hole due to the planar sealing contact between said first portion of said plate lid member and said planar exterior surface of said glass plate.

2. A fluorescent dislay device as recited in claim 1 wherein said oxide solder layer contains a conductor.

3. A fluorescent display device as recited in claim 1 wherein said plate lid member is formed of glass or a material such as ceramic or the like mainly consisting of oxide.

4. A fluorescent display device as recited in claim 1 wherein said plate lid member is formed of a metal material.

5. A fluorescent display device as recited in claim 1 wherein:

(a) said first portion of said plate lid member comprises a circular depression having a flat bottom surface;

(b) said second portion of said plate lid member comprises an annular hollow projection formed concentrically with said circular depression; and (c) said plate lid member further comprises a third portion in the form of an annular flange-like flat portion formed concentrically with said annular hollow projection and extending radially therefrom in spaced relationship to said glass plate, whereby, during assembly of the fluorescent display device, said oxide solder layer is placed in said hollow projection, and, when it is melted, a portion of said oxide solder layer flows radially outwardly between said annular flange-like flat portion and said glass plate.

6. A fluorescent display device hvaing an improved casing, said display device comprising:

(a) a casing body containing an evacuated chamber, said casing body comprising a glass plate having an evacuation hole extending from an exterior opening in the exterior surface of said glass plate to said evacuated chamber, said glass plate having a planar exterior surface surrounding said exterior opening of said evacuation hole, said evacuation hole being used during assembly of the fluorescent display device to evacuate said evacuated chamber;

(b) means for generating fluorescent light disposed in said evacuated chamber;

(c) a plate lid member having a first portion which makes sealing contact with said exterior opening of said evacuation hole and a second portion which is located outwardly of said first portion with respect to said evacuation hole and which is spaced from said glass plate; and (d) an oxide solder layer disposed between said second portion of said plate lid member and said glass plate, whereby, during assembly of the fluorescent display device, said evacuated chamber is evacuated through said evacuation hole, after which said plate lid member is positioned such that its first portion makes sealing contact with said exterior opening of said evacuation hole, after which said plate lid member is fixed in position by melting said oxide solder layer with substantially none of the fumes from the melting solder reaching said evacuated chamber through said evacuation hole due to the sealing contact between said first portion of said plate lid member and said exterior opening of said evacuation hole.

7. A fluorescent display device as recited in claim 6 wherein said oxide solder layer contains a conductor.

8. A fluorescent display device as recited in claim 6 wherein said plate lid member is formed of glass or a material such as ceramic or the like mainly consisting of oxide.

9. A fluorescent display device as recited in claim 6 wherein said plate lid member is formed of a metal material.

10. A fluorescent display device as recited in claim 6 wherein:

(a) said second portion of said plate lid member comprises an annular hollow projection formed concentrically with said first portion and (b) said plate lid member further comprises a third portion in the form of an annular flange-like flat portion formed concentrically with said annular hollow projection and extending radially therefrom in spaced relationship to said glass plate, whereby, during assembly of the fluorescent display device, said oxide solder layer is placed in said hollow projection, and, when it is melted, a portion of said oxide solder layer flows radially outwardly between said annular flange-like flat portion and said glass plate.

* * * * *